US005628155A

United States Patent [19]

Nolte et al.

[11] Patent Number: 5,628,155

[45] Date of Patent: May 13, 1997

[54] FIRE-RESISTANT STRUCTURAL COMPONENT WITH GLASS PANE

[75] Inventors: Hans-Henning Nolte, Gelsenkirchen; Hans-Jürgen Ollech, Herten, both of Germany; Arthur J. Pettit, Wigan Lancashire; David R. Goodall, Merseyside, both of England

[73] Assignees: Flachglas Aktiengesellschaft, Furth, Germany; Pilkington Glass Limited, St. Helens, England

[21] Appl. No.: 340,838

[22] Filed: Nov. 17, 1994

[30] Foreign Application Priority Data

Nov. 19, 1993 [DE] Germany ..... 43 39 331.4
Nov. 19, 1993 [GB] United Kingdom ..... 9323831

[51] Int. Cl.[6] ..... E06B 3/30

[52] U.S. Cl. ..... 52/204.54; 52/204.591; 52/204.71

[58] Field of Search ..... 52/171.1, 204.53, 52/204.54, 204.71, 204.72, 204.591, 204.597, 204.62, 204.67, 204.68

[56] References Cited

U.S. PATENT DOCUMENTS

| | | | |
|---|---|---|---|
| 2,781,561 | 2/1957 | Gifford et al. | 52/204.541 |
| 2,808,355 | 10/1957 | Christie et al. | 52/204.591 X |
| 2,976,969 | 3/1961 | Gillespie | 52/204.591 X |
| 3,201,831 | 8/1965 | Cudini | 52/204.54 |
| 3,728,833 | 4/1973 | Grossman | 52/204.53 |
| 4,134,238 | 1/1979 | Anger | 52/204.591 X |
| 4,257,202 | 3/1981 | Biro | 52/204.591 X |
| 4,852,312 | 8/1989 | Harbom | 52/204.591 X |
| 5,042,212 | 8/1991 | Golen | 52/204.591 |
| 5,205,099 | 4/1993 | Grunhage et al. | 52/204.591 X |

FOREIGN PATENT DOCUMENTS

| | | | |
|---|---|---|---|
| 751697 | 1/1967 | Canada | 52/204.53 |
| 0079257 | 5/1983 | European Pat. Off. . | |
| 3044718 | 9/1981 | Germany . | |

*Primary Examiner*—Lanna Mai
*Attorney, Agent, or Firm*—Herbert Dubno

[57] ABSTRACT

A fire-resistant structural component has a glass pane whose glazing verge is lined with a thermally-conductive material and is held in a frame in which bridge strips conduct heat from a fire side through the thermally-conductive member to radiating bridge strips on the opposite side.

11 Claims, 5 Drawing Sheets

FIRE-RESISTANT STRUCTURAL COMPONENT WITH GLASS PANE

FIELD OF THE INVENTION

Our present invention relates to a fire-resistant structural component having a glass pane and, more particularly, to a glass pane in a fire-resistant structure which is capable of withstanding a fire condition on one side thereof for a minimum period of time.

BACKGROUND OF THE INVENTION

For the purposes of this description, a glazing verge of a glass pane will be understood to be the outwardly-facing margins of a glass pane adjoining the peripheral edge along the broad faces of the pane and the narrow edge face thereof between the broad surfaces. In the case of a glass pane consisting of two glass sheets, i.e. double-glazing, it is the margins of the outer broad faces adjoining the peripheral edges of two glass sheets, the narrow edge faces thereof and the seal between the sheets, i.e. the span between these faces along the narrow sides of the double glazing. Stated otherwise, a glass pane consisting of a single glass sheet has a pair of broad faces adjoining a narrow edge face extending around the periphery. The glazing verge is then defined as this narrow edge face and the margins of the broad faces adjoining the narrow edge face extending around the periphery of a width of the order of the width of the narrow edge face or somewhat greater.

This term is used because it describes the portion of the pane which in glazing is held within the frame in common parlance, and is intended to avoid confusion with terms such as "edge" and "rim" or "corner" which may refer to the sharp junction between faces of the glass pane. Further ramifications of the glazing verge will be described below.

In the prior art fire-resistant structural component described in German Patent document DE 30 44 718 A1, a glazing verge of the glass pane is provided on both of the broad surfaces, i.e. on the margins described above, with a coating of a heat-conductive material. The heat-conductive coating is received in a glazing groove of a frame with an intervening heat-insulating barrier material which can be composed of a fibrous filler.

This construction has been found to be effective as long as the thermal stress on the structure in the case of fire is not excessive and the fire-resistant duration is not expected to be high. To improve the fire-resistance duration, the coating can be extended beyond the free edges of the receiving groove and thus can project inwardly of the frame beyond the heat-insulating filler. However, the combination of the insulation and the frame or coating construction and the thinness of the coating appear to make the assembly incapable of withstanding high thermal stresses and more severe fire conditions.

OBJECTS OF THE INVENTION

It is therefore the principal object of the present invention to provide a fire-resistant structural component having a glass pane of single or double glazing and an increased duration of fire-resistance, even in the case when thermal stresses are extremely high as a result of a fire condition.

It is another object of this invention to provide an improved fire-resistant structural component which is better able to withstand extreme fire conditions than earlier such components.

SUMMARY OF THE INVENTION

These objects and others which will become apparent hereinafter are attained, in accordance with the invention, in a fire-resistant structural component comprising:

- a glass pane having opposite broad faces, a narrow edge face bridging the broad faces, and a glazing verge extending all around a periphery of the glass pane and including the narrow edge face and margins of the broad faces adjoining the edge face; and
- respective heat-conductive layers extending along the glazing verge and in contact with the respective broad faces of the glass pane along the margins and configured to conduct away from the pane elevated thermal fluxes developed in the glazing verge and resulting from a fire to which the component is exposed.

In one aspect of the invention this component can comprise:

- a support frame for the pane including means forming a groove receiving the glazing verge and the layers;
- respective metal bridge strips disposed on opposite sides of the pane and each including:
  - a glazing flange extending into the groove and juxtaposed with a respective one of the layers,
  - a cover section extending away from the pane and adjoining the glazing flange, and
  - a radiating flange adjoining the cover section outwardly thereof, whereby the bridge strip on a fire side of the component takes up thermal energy and the bridge strip on an opposite side of the component dissipates thermal energy from a respective one of the layers to the surroundings.

According to the invention, therefore, the glazing verge of the glass pane is provided along the periphery of the pane with a heat-conductive member which extends onto both broad faces and lies along the narrow face of the pane and which is dimensioned and configured to conduct away from the pane the high thermal fluxes which result in the case of fire.

The holding frame provided with the receiving groove for the glazing verge also is formed on both sides of the glazing verge with the metal profile strips forming thermal bridges and which have, respectively, each a glazing verge flange in contact with the portion of the glazing verge along the margin of the broad face turned toward that bridge profile, a cover section and a radiating flange turned away form the pane. In the case of fire, the bridging profile strip picks up thermal energy at the side of the fire and transfers that thermal energy to the surroundings on the opposite side through a U-section profile forming the thermally-conductive channels fitted onto the glazing verge.

With such a fire-resistant structural component, the retaining frame and the glass-holding strips are generally composed of an appropriate steel alloy or some other suitable metal alloy. However, it is possible to fabricate the retaining frame from wood. The glass holding strips can be formed on the retaining frame or can be independent components or members attached thereto.

According to a feature of the invention, the glazing verge flange is fitted between the metal channel on the glazing verge and the respective glass holding strip or bar and can rest against the channel which directly receives the glazing verge. The cover section of the bridge strip can cover or overlie the glass holding strips or bars facing the glass pane while the radiating flange can lie outwardly of this bar or strip.

Preferably the glass pane is a prestressed glass pane. The prestressed glass pane can be for example a thermally or chemically prestressed float glass or prestressed or nonprestressed glass of low coefficient of thermal expansion, for example, a borosilicate glass or other suitable glasses.

By conducting the heat through the metal channel extending along the glazing verge and in contact with the respective broad faces of the glass pane along these margins and along the narrow edge face, at least for a predetermined period of time and a predetermined temperature range under fire conditions, we can ensure that the temperature gradient between the central region of the glass pane and its margins is initially so small that the critical heating of the glass pane during the fire can adequately be withstood and the failure of the glass pane prevented for the predetermined time period. During further advance of the fire condition or prolongation thereof the described temperature gradient is sufficient that the margins of the glass pane for a relatively long period remain below the glass softening temperature.

This is especially the case when the heat-conductive material is a metal and forms a thermal bridge between the glazing verge of the glass pane and the environment so that at the fire side of the construction, radiation and convection act upon the heat-bridging strip while on the opposite side, the heat-bridging strip extends into a cold environment with the thermal flux being conducted from the strip on the fire side to the strip on the cold side through a heat-conductive channel enclosing the glazing verge. Heat transfer in both cases is effected by radiation and convection, the heat picked up by the bridge strip at the fire side being dissipated into the cooler environment by the bridge strip on the colder side. The resulting cooling, especially by drawing heat away from the conductive member enclosing the glazing verge of the glass pane, ensures long-term stability of the pane and hence the construction incorporating it.

Within the invention there are many possibilities with respect to particular configurations of the pane or panes, the groove or grooves, the retaining bars and the bridge strips.

While it is important to the invention only that the margins of the broad faces of the glass pane at the glazing verge be provided with the thermally conductive jacket or layer, we prefer to provide that jacket or layer as a U-shaped channel which encloses the glazing verge. The conductive member can thus be composed of sheet metal strips, of a metal structural shape or profile, from galvanically-deposited or vapor-deposited metal strips or as a highly thermally-conductive enameling layer.

Because the thermally-conductive material is applied against the glass surfaces of the glazing verge, in spite of a relatively small thickness of the layer, a high thermal flux can be provided in the region of the glazing verge. When metal strips or metal profiles (e.g. a metal channel) are used, the sheet metal can have a thickness of less than a millimeter and preferably in the range of 0.2 to 0.6 mm.

According to a feature of the invention, the glazing verge of the glass pane can be etched to provide a bonding surface. The etching removes microcracks which, in the case of fire, can provide incipient rupture zones. The metal channel can be applied to the etched region.

Within the ambit of the present invention, moreover, is the provision of thermal insulation material between the thermally-conductive bridge strips and the glass-holding bars.

When the retaining frame is composed of metal, thermally-conductive bridge strips are provided in the manner described and the glazing verge is provided with the thermally-conductive jacket, the resulting fire-resistant structural component can have a fire-resistance duration under a fire test in accordance with German Industrial Standard DIN 4102 in excess of 60 minutes and usually in excess of 90 minutes.

According to a feature of the invention, the thermally-conductive bridge profile strips are composed of a highly conductive metal alloy whose melting point lies below the melting point of the glass pane. In this case, the strips can be composed of aluminum alloys, tin alloys or copper alloys. Because of the phase transformation upon melting of the strips, an additional cooling effect is generated.

It has been found to be advantageous, moreover, if the thermally-conductive bridge profile strips at least on their cover section and the radiation flange are formed with a coating, e.g. a painted coating for a high degree of infrared absorption and infrared emissivity. With such coatings, still additional cooling effects can be achieved. Best results in the latter case are obtained when at least the fire side bridge strip partly melts under the fire condition so that the phase transformation cooling is superimposed upon the radiant cooling.

The combination of cooling effects described can provide, with a fire-resistant structural component of the present invention that, while the thermal energy is delivered from the outset at the fire side to the glazing verge of the glass pane, only when the temperature increase at the glazing verge is such that the temperature approaches the softening point of the glass, is sufficient thermal flow conducted away at the cool side to prevent the softening point from being reached, thereby enabling, by radiant and convective cooling at the cool side, the structural component to withstand the fire condition for the desired length of time. This can be optimized by combining the radiant and convective cooling with the aforementioned phase transformation.

When the thermally-conductive jacket for the glazing verge is a channel provided with a groove receiving the glazing verge and the lateral shanks of this channel are in direct thermal contact with both broad surfaces of the glass pane, a certain amount of heat is conducted to the glazing verge of the glass pane. In the case of a channel, which can be a thicker coating, the thermal flux is greatly enhanced so that the edge heating along the glass pane is more uniform and thermal stresses are precluded from developing within the pane.

At least one of these lateral shanks has a length which corresponds generally to the thickness of the pane or to the thickness of the double glazing when plural panes are provided in the channel. Of course, both lateral shanks can be of equal length.

Preferably the channel is composed of metal with a thickness greater than 0.5 mm and preferably greater than 1 mm. A preferred thickness is about 2 mm.

While the channel can be provided on the entire periphery of the glass pane, that is not necessary. Since crack formation in the case of fire generally occurs at the center of the longer sides of the pane, if desired, the channel can be provided only at the longer side or both at the longer and shorter side of the pane, leaving the corners of the glass pane unjacketed.

With a glass pane of a certainly large ratio of lengths of the sides, for example 2:1, the channels can be provided only along the longer sides. Preferably, however, the channels are provided on at least two-thirds of the periphery of the glass pane and more preferably at least 80% of the periphery with best results being obtained with at least 90% of the periphery being provided with the channel jacket or jackets.

Of course, when the full periphery of the glass pane is jacketed in the manner described, one need not be concerned that a location at which incipient crack formation can occur will remain unjacketed.

The jacket need not be continuous and, in accordance with the invention, the glazing verge of the glass pane may be received in a plurality of channel segments. Preferably the channels are composed of extruded metal. From the point of view of mounting, it is advantageous when the thermally-conductive members are preformed. The channels thus can have in addition to the lateral flanks, a base connecting them so as to be of U-section. Since the fire-resistance of glass generally increases with the thickness of the glass, preferably the glass should have a thickness of at least 10 mm. The channel can have a width of at least 10 mm to snugly receive the glazing verge. With widths of this magnitude, the channel can be provided with a rib opposite its groove and enabling the rib to be received in the frame.

Instead of a single glass sheet, the glass pane can be provided with a plurality of glass sheets and preferably is a double-glazed unit. Reinforced glass and laminated glass can also be used.

Preferably the heat-conductive element is fitted into a receiving groove of a support frame in such manner that the lateral shanks of the channel abut the glass-retaining bars. The lateral shanks of the thermally-conductive channels, however, should also project beyond the glass-retaining bars. Preferably the degree to which the lateral shanks project beyond the glass-retaining bars is at least 10 mm.

According to another feature of the invention, these lateral shanks are covered by a decorative molding or covering. This molding can be composed of plastic which can melt in the case of a fire and expose the thermally-conductive channel to the radiant energy of the fire. Alternatively, the decorative molding can be composed of a thermally-conductive material, for example, a metal and, indeed, the decorative covering can be colored if desired.

Advantageously, the thermally-conductive channel is fitted onto the periphery of the glass pane prior to the transport of the latter from the plant fabricating the glass pane. This has the advantage that the glazing verge of the glass pane is protected during handling, transport and glazing by the channel. Mechanical injury to the glazing verge can be avoided and, since a mechanical injury to the glazing verge may affect the fire resistance of the glass pane, the fire resistance is maintained in spite of the handling thereof. This is especially advantageous when the glass is prestressed or hardened glass which might otherwise have a tendency to crack without warning. In such cases it is advantageous to free the glazing verge of the glass pane from microcracks and crack-forming points, e.g. by etching in the manner described. It has been found to be advantageous, moreover, to subject the glass pane to prestressing following the treatment of the glazing verge to be free from microcracks and crack-forming points and then to incorporate the glazing verge in the thermally-conductive jacket.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
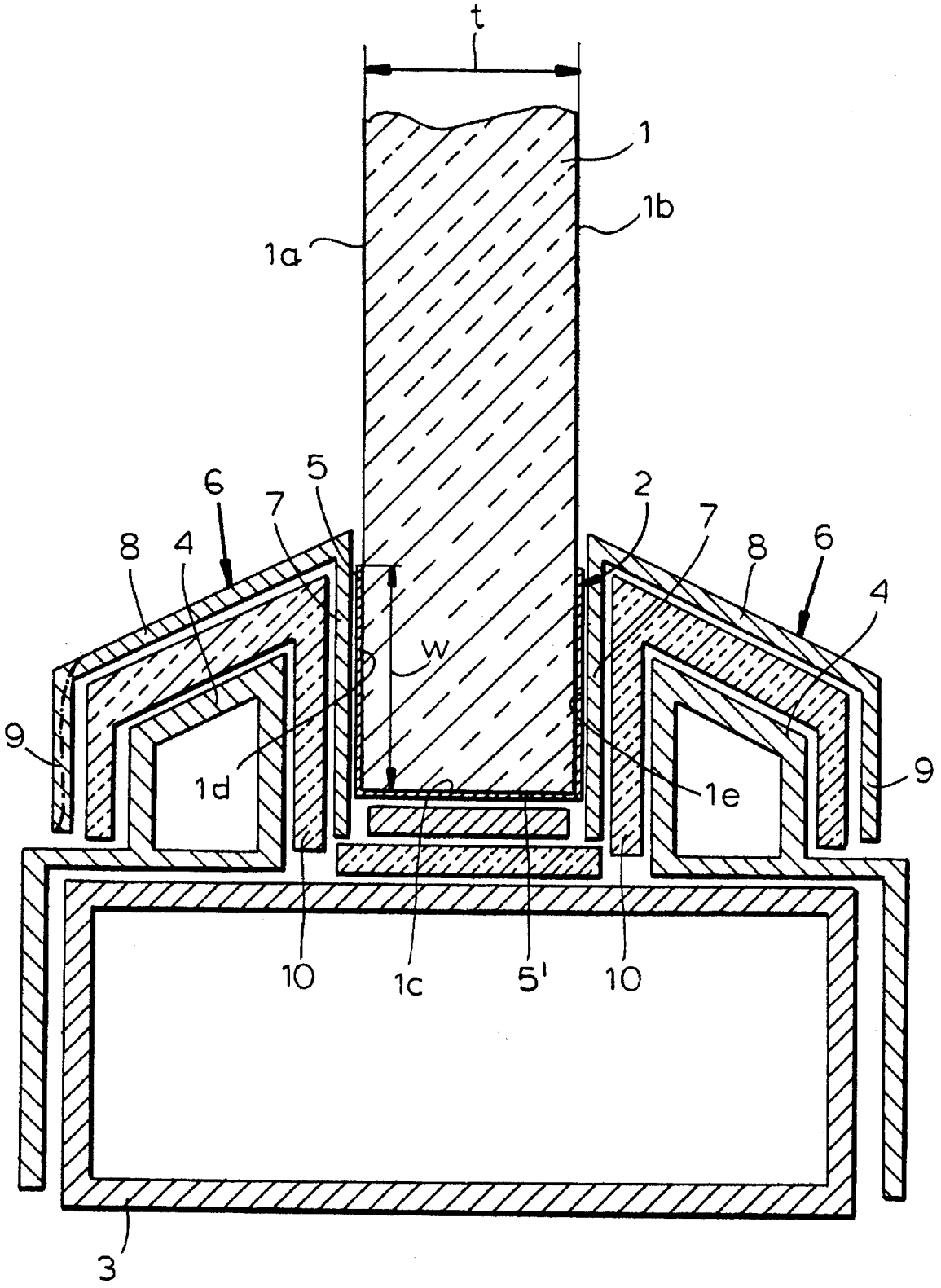
FIG. 1 is a vertical section through a fire-resistant structural component according to the invention showing a first embodiment of single-pane glazing.

The fire-resistant structural component illustrated in the drawing comprises, as can be seen from FIG. 1, a prestressed glass pane 1 which has a peripheral glazing verge represented generally at 2 and constituted by the portions of the broad faces 1*a* and 1*b* of the glass pane directly adjoining the periphery and the edge face 1*c* of the glass pane bridging the margins of the broad faces at these regions. In general, the marginal portions of the broad faces which constitute the glazing verge are regions extending inwardly from the edge by an amount equal to at least the thickness t of the glass pane or the thickness of a double pane or double glazing. The margins can be of greater width w equal up to say 5 t. Preferably the marginal width forming the glazing verge according to the invention is between 1 t and 3 t, it being understood that, in the case of multiple glazing, i.e. where the pane consists of multiple glass sheets, it is the entire thickness of the pane and the multiple glazing that is represented by t.

Figure 2:
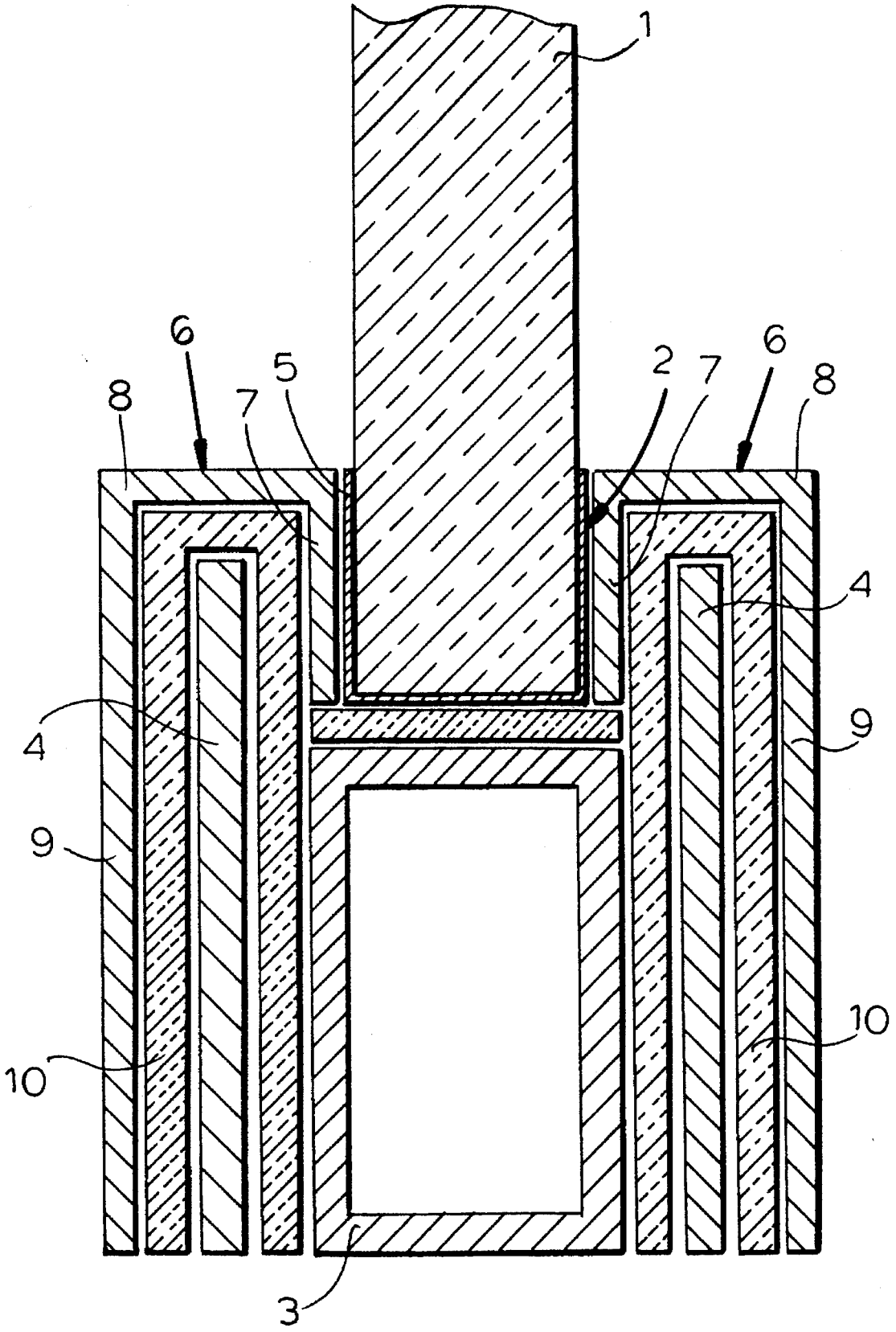
FIG. 2 is a view similar to FIG. 1 showing another embodiment thereof.

The glazing verge 2 of the glass pane 1 (FIG. 1) is provided on both of the margins 1*d* and 1*e* of the broad faces with thermally-conductive layers 5 in contact with these margins. In FIGS. 1 and 2, moreover, a web 5' of the conductive layer lies against the edge face 1*c* and the layers 5 and the web 5' may be formed in a single piece and may be continuous with one another.

In FIGS. 1 and 2, the glazing verge 2 is mounted in a metal retaining frame 3 formed with a receiving groove for the glazing verge defined between a pair of beads or ribs 4.

In FIGS. 1 and 2, moreover, these beads or ribs 4 are separate parts which may be composed of metal and may be fastened on the frame 3.

On both sides of the glazing verge 2, metallic heat-bridging profile strips 6 are provided which can generally be of inverted U cross section and can each have a glazing verge flange 7 turned toward and abutting the thermally-conductive layer 5 on the respective side of the glass pane 1, a cover section 8 which overlies the bead 4 on the respective side and a radiating flange 9 turned away from the glass pane 1. Each bridge strip 6 in the case of a fire thus can serve as a conductor of thermal energy. On the fire side of the structural component shown in FIG. 1, the bridge strip 6 picks up thermal energy and transfers it via the thermally-conductive layers 5 and 5' to the bridge strip 6 at the cool side of the structural component where the thermal energy is dissipated to the environment.

In the embodiments of FIGS. 1 and 2, moreover, the members 5, 5' form a U-shaped sheet metal profile or channel which can be snugly fitted over the glazing verge. They can, however, be applied galvanically, i.e. by electroplating or by vapor deposition or painted or screened onto the glass as a high thermally-conductive enameling which can be fired to bond to the glass. The surfaces 1*d* and 1*e* of the margin are previously etched to removed microcracks at locations at which incipient crack formation can occur so that in the regions at which the metal channel abuts the glass, there will be no danger of crack formation.

Between the bridge strips 6 and the glass-retaining beads 4, a thermal insulation 10 can be provided.

The bridge strip 6 can be composed of high heat-conductivity metal alloys whose melting point lies below the melting point of the glass pane 1. Particularly preferred are aluminum alloys which can undergo face transformation cooling by melting and thus further protect the pane 1 by at least partial melting in the case of a fire at the side of the fire. The beginnings of such melting are shown at the left side in FIG. 1 for the strip 6 in dot-dash lines. The entire assembly in FIGS. 1 and 2 can be fabricated so that the fire resistance in a test, according to German Industrial Standard DIN 4102, is in excess of 60 minutes and preferably in excess of 90 minutes.

Figure 3:
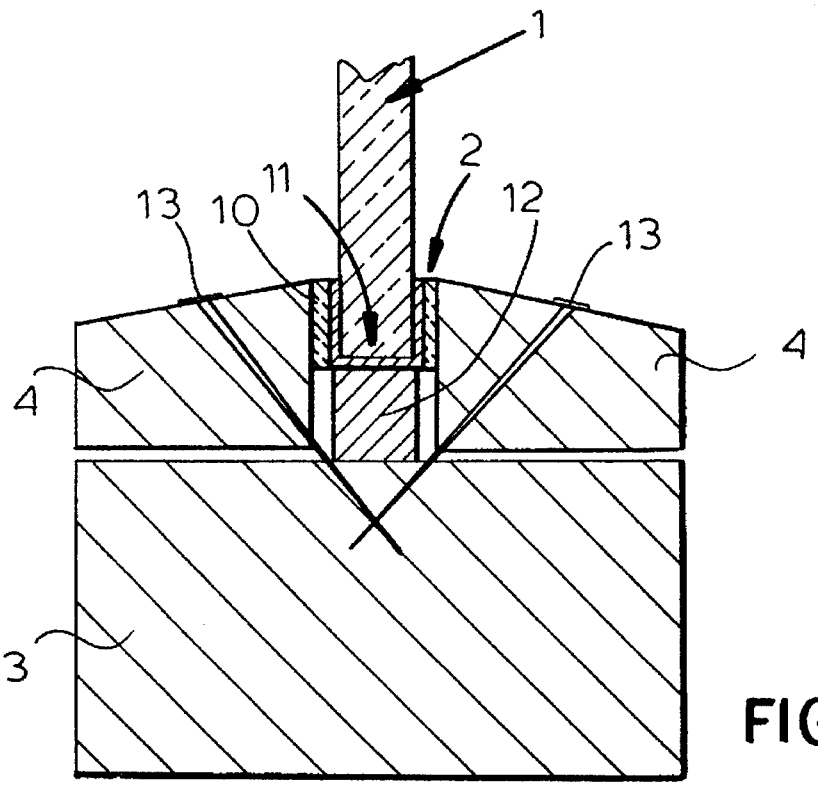
FIG. 3 is a diagrammatic cross sectional view of a glazing assembly in according with another aspect of the invention.

In FIGS. 3–8, the metal member 5 is a thermally-conductive channel 11 which receives a glazing verge 2. At least the two broad faces of the pane 1 are in contact with the lateral shanks 11*a* and 11*b* of the channel 11. The glass panes 1 are preferably prestressed soda lime glass advantageously with a thickness of 10 mm. The thickness can, however, range from 6 mm to 15 mm. Especially preferred is highly prestressed soda lime glass. In the trade, when one refers to prestressed soda line glass, a prestress of 70 MPa to 85 MPa is customarily understood, while strongly prestressed glass is understood to be prestressed in a range in excess of 85 MPa. The upper limit is unimportant and can be any for the purposes of this invention. In FIG. 3, the beads 4 are constituted as wooden strips which are connected to a wooden retaining frame by steel screws 13 which can be countersunk.

The frame is composed of wood in the embodiments of FIGS. 4–8 as well. In all of these Figures, insulating material can be provided at 10.

In FIG. 3 the lateral shanks of the channel 11 can have lengths equal to the glass thickness. The channel 11 is composed of metal and has a sufficient thickness for the requisite thermal conductivity, e.g. 2 mm. With greater thicknesses, gains in thermal conductivity are not material although the cost is significantly greater.

The channels 11 may be composed of aluminum or aluminum alloys or stainless steel and preferably the channel is preformed and cut to length and bent to fit onto the glass. The channels can also be formed by extrusion.

For good thermal contact between the glass verge 2 and the channel or metal layers 5, at least the marginal portions of the glass pane should be in direct contact with the channel and the channel should tightly hug the glazing verge. However, if desired, high thermal conductivity pasty or adhesive substances can be applied between the channel 11 and the glass pane.

The shanks 11*a* and 11*b* of the channel 11 may be bent toward one another so that they are partly spread by insertion of the glazing verge of the glass pane between them to ensure an intimate contact.

The channels 11 can be provided continuously around the glass pane or can be applied to the glass pane in sections, thereby simplifying mounting on the glass pane.

In FIG. 3 the base 11*c* of the channel 11 is also in thermal contact with the edge face of the pane. This is advantageous in cases in which adhesive is not applied to the glazing verge.

Figure 4:
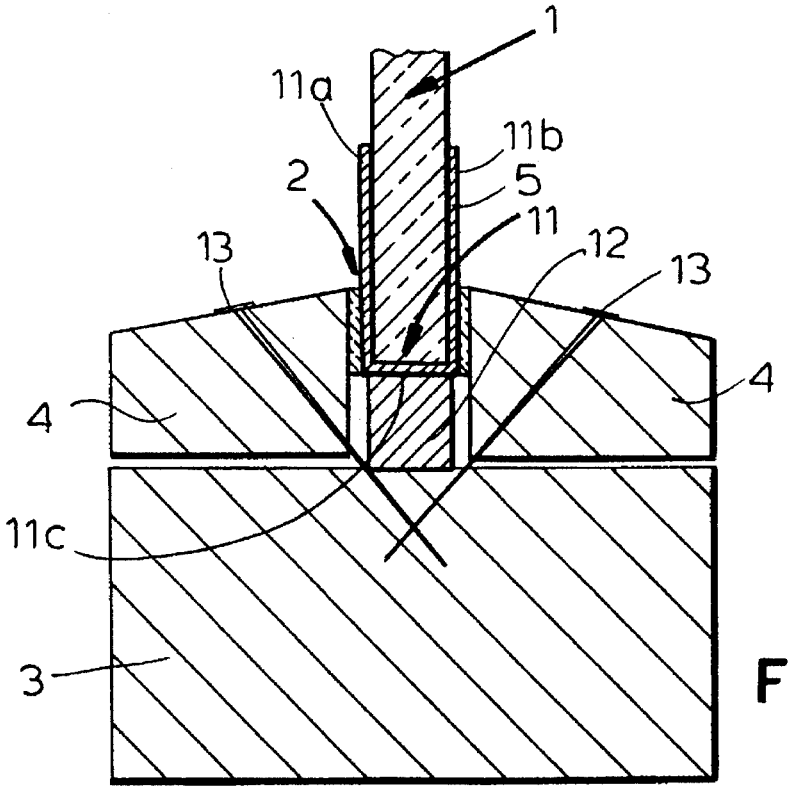
FIG. 4 is a diagram illustrating a modification of this second system.

The thermally-conductive member 5 should be sufficient to absorb the radiation from a fire upon the structural component. In FIG. 4, for example, the lateral shanks 11*a* and 11*b* are extended inwardly beyond the beads 4 to ensure that radiating heat form the fire will be more readily carried away. Preferably the lateral shanks project at least 10 mm inwardly toward the groove of the frame 3 in which the glazing verge is received.

Figure 5:
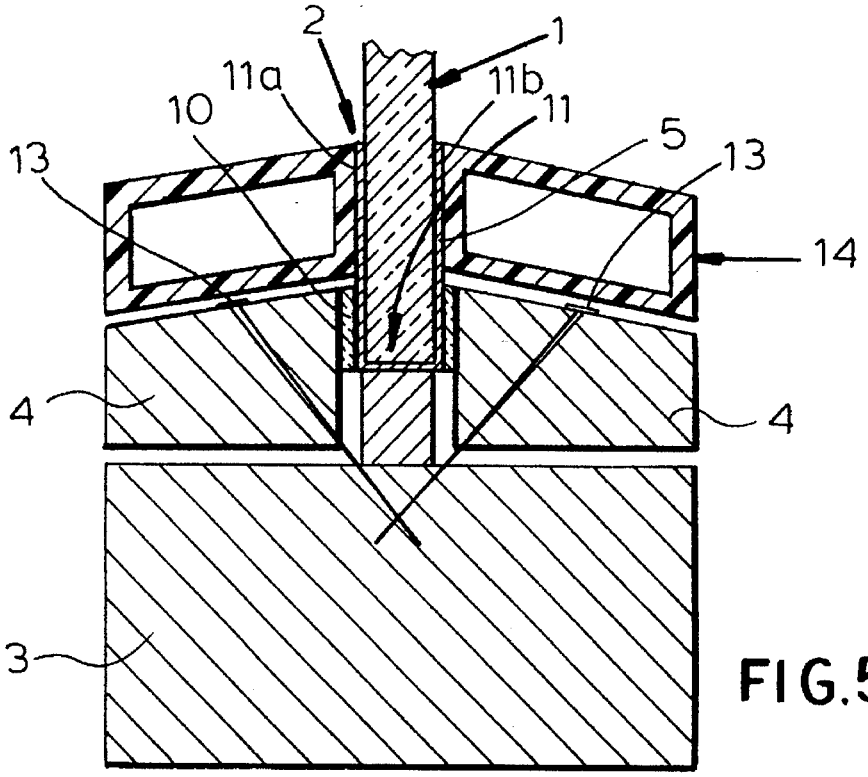
FIG. 5 illustrates a glazing assembly of FIG. 3 further provided with decorative molding according to the principles of the invention.
Figure 6:
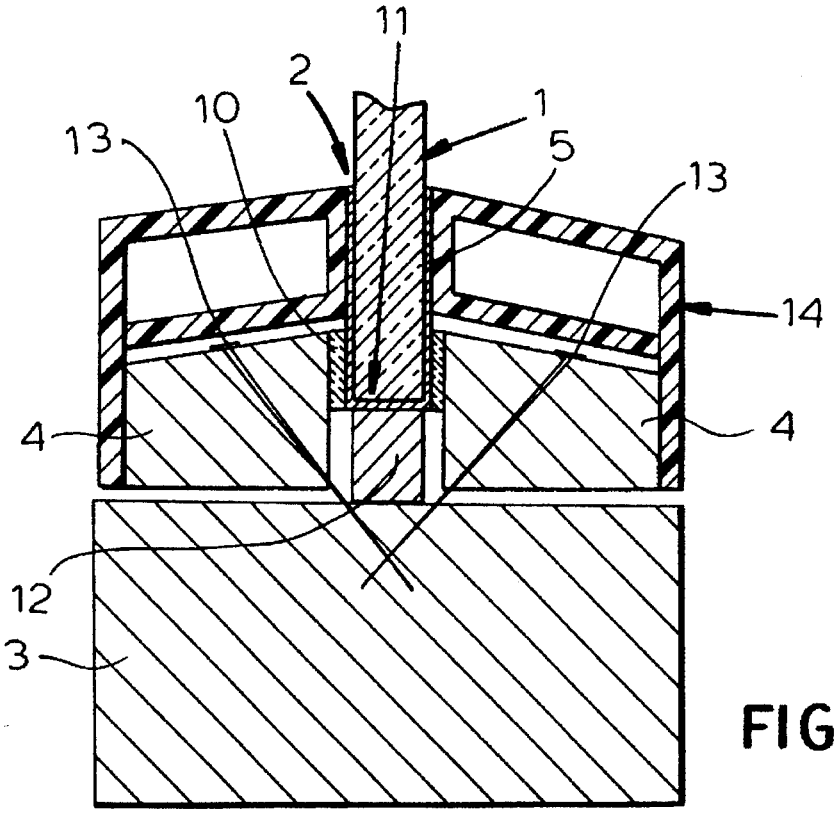
FIG. 6 is a view similar to FIG. 5 showing the application of decorative molding to a system of the type shown in FIG. 4.

While the projecting lateral shanks are visible in FIG. 4, in FIGS. 5 and 6 they are concealed by decorative moldings 14 which can be composed of extruded metal or plastic and are provided on the beads 4 but do not substantially reduce the thermal pick up of the member 5.

Metal moldings 14 can directly contact the lateral shanks 11*a* and 11*b* and when plastic moldings are used in combustible plastics should be employed which melt in the case of fire and thereby expose the channel 11.

In FIG. 6 the decorative molding 14 is so configured that it covers the bead 4.

Figure 7:
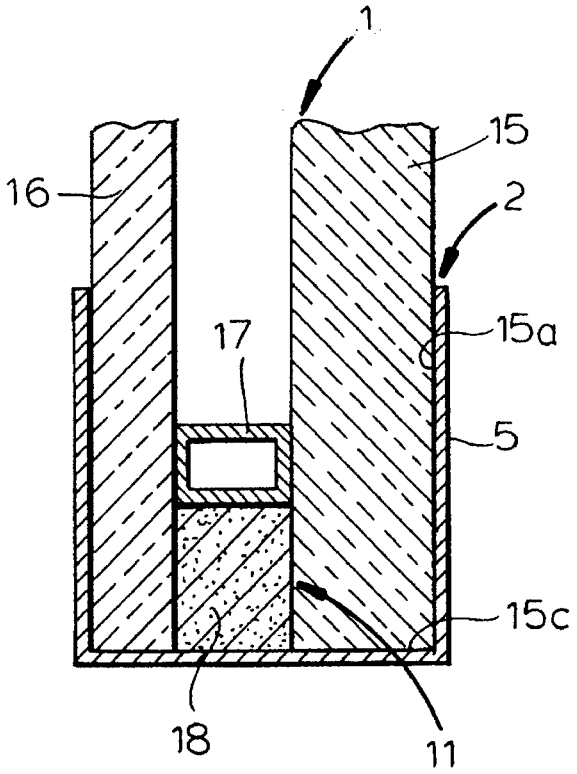
FIG. 7 is a diagrammatic illustration of the glazing verge of a double-pane assembly according to the invention.

Instead of a single glazing as in FIGS. 3–6, double glazing can be used (see FIG. 7). The pane 1 is here formed by two glass sheets 15 and 16 separated by a spacer 17 of a heat-resistant material such as steel. The sealing mass 18 can also be composed of a material with a high-temperature resistance, for example, a silicone. At least one pane 15 should then have the requisite fire resistance and can be composed of strongly prestressed sodium lime glass with its margin 15*a* and edge face 15*c* etched to be free from microcracks and crack-forming points. The other pane 16 can be composed of commercial glass of smaller thickness. Both panes 15 and 16, however, can be constituted of fire-resistant glass if desired.

In any case, the double glass pane 1 is received in a channel 11 of a width to accommodate the pane and can be mounted in a retaining frame 3 in the manner described in FIGS. 3–6.

Figure 8:
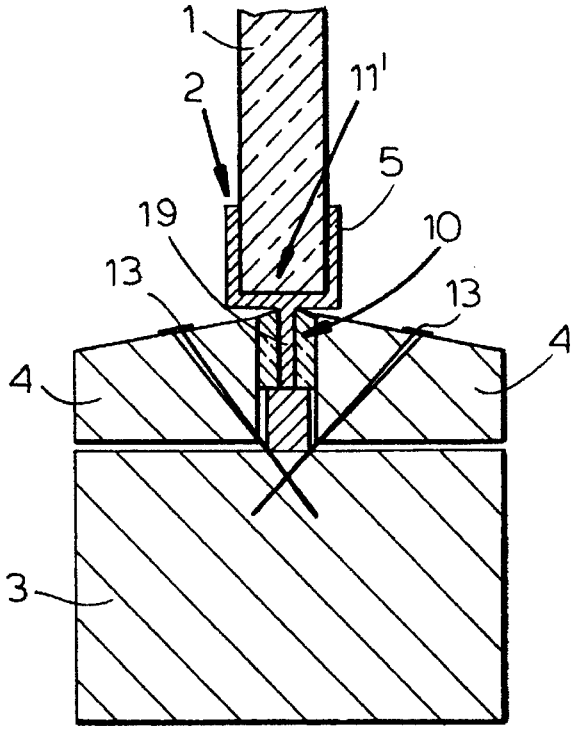
FIG. 8 is a cross sectional view of still another single-pane glazing system embodying the invention.

FIG. 8 shows an embodiment in which the glass pane 1 has a thickness greater than the width of the groove in the frame 3 between the beads 4. In this case, the channel 11' is formed with a rib 19 which is received in the frame groove while the glazing verge 2 is received in the channel. Preferably the width of the rib is so selected that it corresponds to the standard glass thickness. In this embodiment as well decorative moldings can be applied.

We claim:

1. A fire-resistant structural component, comprising:

a glass pane having opposite broad faces, a narrow edge face bridging said broad faces, and a glazing verge extending all around a periphery of the glass pane and including said narrow edge face and margins of said broad faces adjoining said edge face;

respective heat-conductive layers extending along said glazing verge and in contact with the respective broad faces of the glass pane along said margins and configured to conduct away from said pane elevated thermal fluxes developed in said glazing verge and resulting from a fire to which said component is exposed; a support frame for said pane including means forming a groove receiving said glazing verge and said layers; and respective metal bridge strips disposed on opposite sides of said pane and each including:

a glazing flange extending into said groove and juxtaposed with a respective one of said layers, a cover section extending away from said pane and angularly adjoining said glazing flange, and a radiating flange angularly adjoining said cover section outwardly thereof, and generally parallel to the respective glazing flange whereby the bridge strip on a fire side of said component takes up thermal energy and the bridge strip on an opposite side of the component dissipates thermal energy from a respective one of said layers to the surroundings.

2. The fire-resistant structural component defined in claim 1 wherein said means forming said groove receiving said glazing verge and said layers includes a pair of beads of said frame defining said groove between them, said glazing flange of the respective bridge strip lying between the respective bead and the respective layer, said cover section of the respective bridge strip extending across the respective bead and the radiating flange of the respective bridge strip extending along an outer side of the respective bead.

3. The fire-resistant structural component defined in claim 1 wherein said layers form a U-section strip extending around said glazing verge.

4. The fire-resistant structural component defined in claim 1 wherein said layers are selected from the group which consists of sheet metal strips, a sheet metal profile, galvanically applied metal coatings, vapor-deposited metal coatings and high heat conductivity enameling.

5. The fire-resistant structural component defined in claim 1 wherein said glazing verge of said pane has etched bonding surfaces for bonding to said layers.

6. The fire-resistant structural component defined in claim 1 wherein said means forming said groove receiving said glazing verge and said layers includes a pair of beads of said frame defining said groove between them, further comprising a respective thermal insulating strip between each of said beads and the respective bridge strip.

7. The fire-resistant structural component defined in claim 1 wherein said frame is composed of metal and said bridge strips and said layers are so configured that said component has a fire retardance duration in excess of 60 minutes.

8. The fire-resistant structural component defined in claim 1 wherein said bridge strips are composed of a metal alloy having a high thermal conductivity and a melting point below a melting point of the glass pane.

9. The fire-resistant structural component defined in claim 1 wherein said bridge strips are formed at least over said cover section and said radiating flange with an infrared-absorption and infrared-emissivity increasing coating.

10. The fire-resistant structural component defined in claim 1 wherein said bridge strips and said layers are so formed that the bridge strip on a fire side of said component melts at least at a limited region thereof within a fire-resistance duration of the component.

11. The fire-resistant structural component defined in claim 1 wherein said pane is a prestressed glass pane.

* * * * *